US008970567B2

(12) United States Patent
Ka et al.

(10) Patent No.: US 8,970,567 B2
(45) Date of Patent: Mar. 3, 2015

(54) ORGANIC LIGHT EMITTING DISPLAY AND METHOD OF DRIVING THE SAME

(75) Inventors: Ji-Hyun Ka, Yongin (KR); Won-Kyu Kwak, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 159 days.

(21) Appl. No.: 13/584,731

(22) Filed: Aug. 13, 2012

(65) Prior Publication Data

US 2013/0222437 A1 Aug. 29, 2013

(30) Foreign Application Priority Data

Feb. 27, 2012 (KR) ..... 10-2012-0019680

(51) Int. Cl.
*G09G 3/32* (2006.01)

(52) U.S. Cl.
USPC ..... 345/204

(58) Field of Classification Search
None
See application file for complete search history.

(56) References Cited

U.S. PATENT DOCUMENTS 7,616,173 B2 * 11/2009 Tanada ..... 345/51

FOREIGN PATENT DOCUMENTS

| | | |
|---|---|---|
| KR | 10-2007-0024143 | 3/2007 |
| KR | 10-2010-0039066 | 4/2010 |
| KR | 10-2011-0072283 | 6/2011 |

* cited by examiner

*Primary Examiner* — Joseph Haley
(74) *Attorney, Agent, or Firm* — Christie, Parker & Hale, LLP

(57) ABSTRACT

An organic light emitting display includes first scan lines, data lines, and first emission control lines at an active region for displaying an image, second scan lines and second emission control lines at a blank region where no image is displayed, pixels coupled to the first scan lines, the data lines, and the first emission control lines in the active region, a dimming controller for controlling brightness of the pixels, and an emission control line driver for supplying emission control signals to the first and second emission control lines corresponding to control of the dimming controller so that a light-emitting area including ones of the pixels is uniform in the active region.

9 Claims, 5 Drawing Sheets

ORGANIC LIGHT EMITTING DISPLAY AND METHOD OF DRIVING THE SAME

CROSS-REFERENCE TO RELATED APPLICATION

This application claims priority to and the benefit of Korean Patent Application No. 10-2012-0019680, filed on Feb. 27, 2012, in the Korean Intellectual Property Office, the entire content of which is incorporated herein by reference.

BACKGROUND

1. Field

Embodiments of the present invention relate to an organic light emitting display and a method of driving the same.

2. Description of the Related Art

Recently, various flat panel displays (FPDs) capable of reducing the weight and volume that are disadvantages of cathode ray tubes (CRTs) have been developed. The FPDs include liquid crystal displays (LCDs), field emission displays (FEDs), plasma display panels (PDPs), and organic light emitting displays.

Among the FPDs, the organic light emitting displays display images using organic light emitting diodes (OLED) that generate light by recombination of electrons and holes. The organic light emitting display has high response speed, and is driven with low power consumption. In a common organic light emitting display, currents corresponding to data signals are supplied to organic light emitting diodes (OLED) using the transistors formed in each of the pixels so that the OLEDs emit light.

The conventional organic light emitting display includes a data driver for supplying data signals to data lines, a scan driver for sequentially supplying scan signals to scan lines, an emission control line driver for supplying emission control signals to emission control lines, and a display unit including a plurality of pixels coupled to the data lines, the scan lines, and the emission control lines.

The pixels included in the display unit are selected when the scan signals are supplied to the scan lines to receive the data signals from the data lines. The pixels that receive the data signals generate light components of brightness components corresponding to the data signals to display an image. Here, the emission times of the pixels are controlled by the emission control signals supplied by the emission control lines. In general, the emission control signals are supplied to overlap the scan signals supplied to one scan line or two scan lines to set the pixels to which the data signals are supplied to be in a non-emission state.

On the other hand, the organic light emitting display controls the brightness of a panel, that is, dimming while controlling the width of the emission control signals. Here, since the width of the emission control signals increases during dimming driving, when the pixels emit light once in one frame period, flicker noise may be generated. Therefore, during the dimming driving, a 2-duty driving method is used so that the pixels are turned on/off twice in the one frame period.

For example, the emission control signals supplied to the emission control lines E1, E2, . . . as illustrated in FIG. 1 to realize dimming are set so that emission is performed twice in the one frame period. However, in the 2-duty driving method, when a light-emitting region is set as a blank region in accordance with the emission control signals, the voltage value of a first power source ELVDD that supplies currents to the pixels changes so that noise in the form of horizontal stripes may be generated.

Describing the above in detail, a panel is divided into an active region and a blank region as illustrated in FIG. 2. In the active region, the pixels realize gray levels. In the blank region, no image is displayed. That is, the blank region does not emit brightness. During the manufacturing process, a plurality of scan lines and emission control lines are formed.

On the other hand, when the pixels emit light in the first region 1 and the second region 2 of the active region by the emission control signals, the first power source ELVDD is set as the voltage of a first voltage V1, as illustrated in FIG. 3. However, when a light-emitting region is positioned in the blank region by the emission control signals, that is, when only the first region 1 emits light in the active region, the first power source ELVDD is set as a second voltage V2 higher than the first voltage V1. That is, when a light-emitting region is positioned in the blank region by the emission control signals, the number of pixels that emit light is reduced, and the first power source ELVDD is set as the second voltage V2 higher than the first voltage V1 to correspond to low voltage drop. In this case, the brightness of the first region 1 positioned in the active region increases so that noise in the form of horizontal stripes may be generated.

SUMMARY

Accordingly, embodiments of the present invention provide an organic light emitting display capable of improving display quality and a method of driving the same.

To achieve the foregoing and/or other aspects of embodiments of the present invention, there is provided an organic light emitting display including first scan lines, data lines, and first emission control lines at an active region for displaying an image, second scan lines and second emission control lines at a blank region where no image is displayed, pixels coupled to the first scan lines, the data lines, and the first emission control lines in the active region, a dimming controller for controlling brightness of the pixels, and an emission control line driver for supplying emission control signals to the first and second emission control lines corresponding to control of the dimming controller so that a light-emitting area including ones of the pixels is uniform in the active region.

The emission control line driver may supply the emission control signals so that ones of the pixels receiving the emission control signals are turned on and off at least two times in one frame.

The organic light emitting display may further include a scan driver for supplying scan signals to the first scan lines and the second scan lines, and a data driver for supplying data signals to the data lines.

A scan signal of the scan signals supplied to a scan line of the first and second scan lines at a horizontal line may overlap an emission control signal of the emission control signals supplied to an emission control line of the first and second emission control lines at the horizontal line.

When the pixels are turned on and off twice, the emission control line driver may supply the emission control signals so that a first light-emitting region and a second light-emitting region are in the active region.

According to other embodiments of the present invention, there is provided a method of driving an organic light emitting display including a panel including an active region for displaying an image, and a blank region in which no image is displayed, the method including sequentially supplying scan signals to first scan lines to select pixels in the active region, and supplying emission control signals for controlling emission times of the pixels, wherein a width of the emission control signals is controlled so that the pixels are turned on and off at least two times in one frame period, and so that a light-emitting area including ones of the pixels is uniform in the active region.

The method may further include sequentially supplying the scan signals to second scan lines in the blank region.

A scan signal of the scan signals supplied to a scan line of the first and second scan lines at a horizontal line may overlap an emission control signal of the emission control signals supplied to an emission control line of the emission control lines at the horizontal line.

When the pixels are turned on and off twice, a width of the emission control signals may be controlled so that a first light-emitting region and a second light-emitting region are in the active region.

In the organic light emitting display according to embodiments of the present invention, and in the method of driving the same, the width of the emission control signals is controlled so that the light-emitting region that emits light in the active region is uniform so that it is possible to reduce or prevent stripes from being generated in displayed images.

BRIEF DESCRIPTION OF THE DRAWINGS

The accompanying drawings, together with the specification, illustrate exemplary embodiments of the present invention, and, together with the description, serve to explain the aspects of embodiments of the present invention.

DETAILED DESCRIPTION

Figure 1:
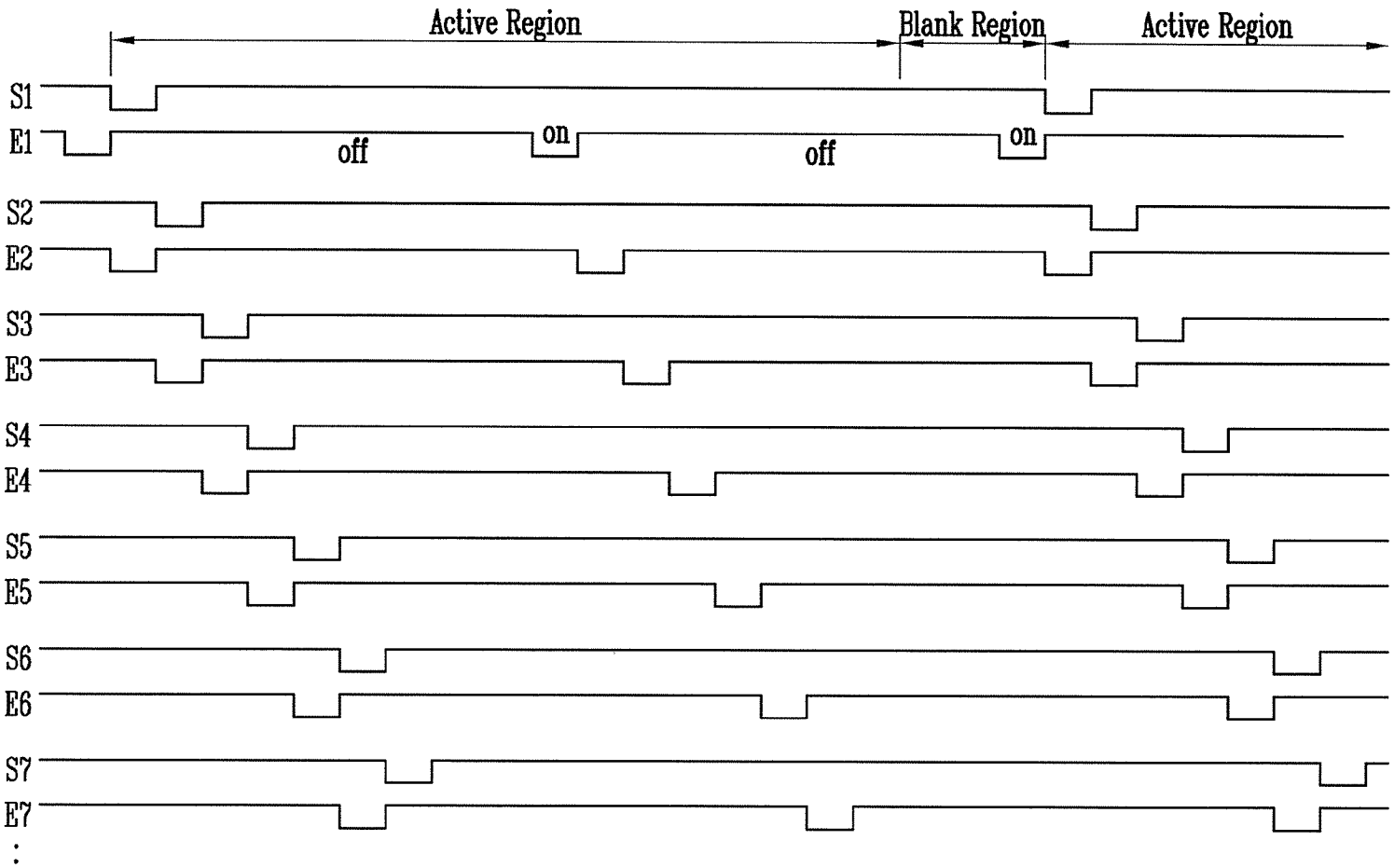
FIG. 1 is a waveform chart illustrating an example of a 2-duty driving method.
Figure 2:
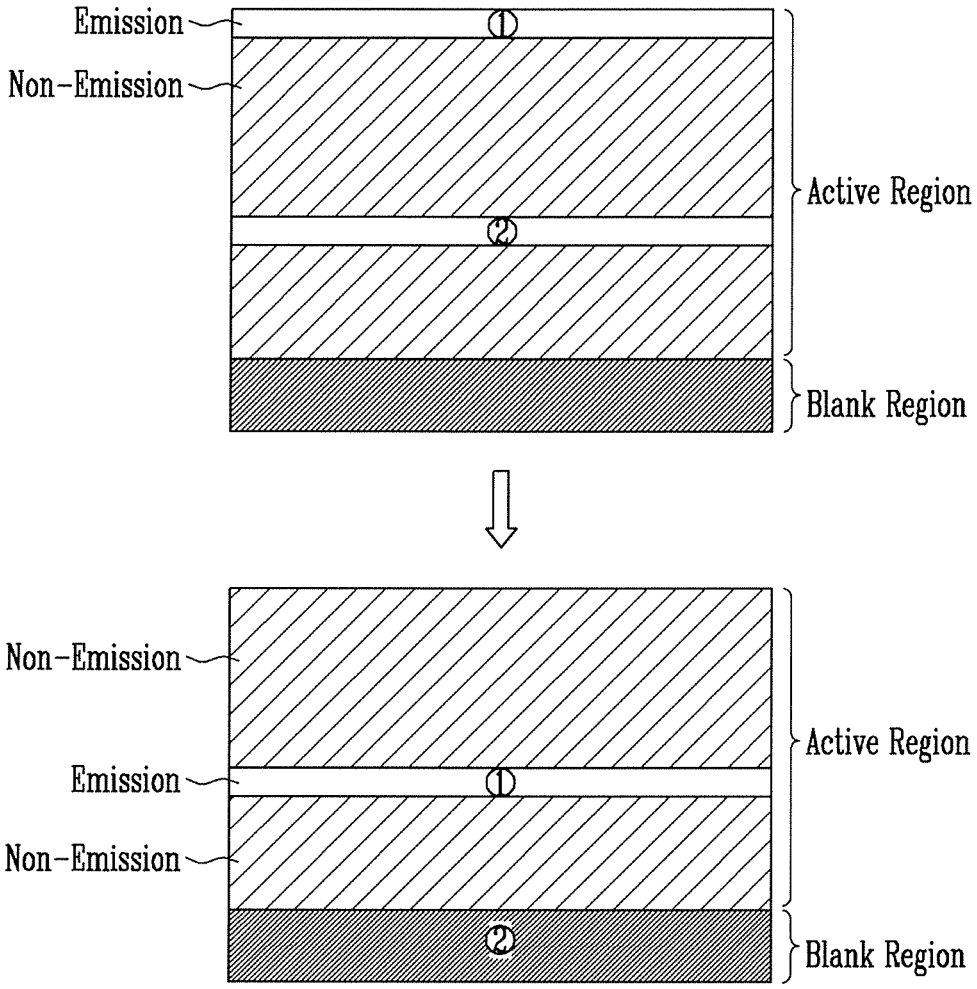
FIG. 2 is a view illustrating a light-emitting region by the 2-duty driving method of FIG. 1.
Figure 3:
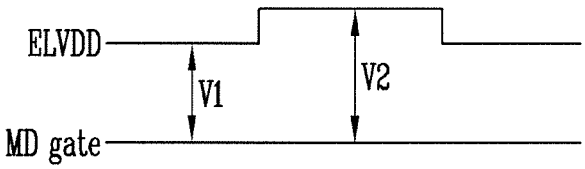
FIG. 3 is a view illustrating a change in the voltage of a first power source corresponding to the light-emitting region illustrated in FIG. 2.

Hereinafter, certain exemplary embodiments according to the present invention will be described with reference to the accompanying drawings. Here, when a first element is described as being coupled to a second element, the first element may be not only directly coupled to the second element, but may also be indirectly coupled to the second element via one or more other elements. Further, some of the elements that are not essential to the complete understanding of the invention are omitted for clarity. Also, like reference numerals refer to like elements throughout.

Hereinafter, an organic light emitting display according to embodiments of the present invention and a method of driving the same will be described in detail with reference to FIGS. 4 to 7, in which exemplary embodiments by which those of ordinary skill in the art may easily perform the present invention are included.

Figure 4:
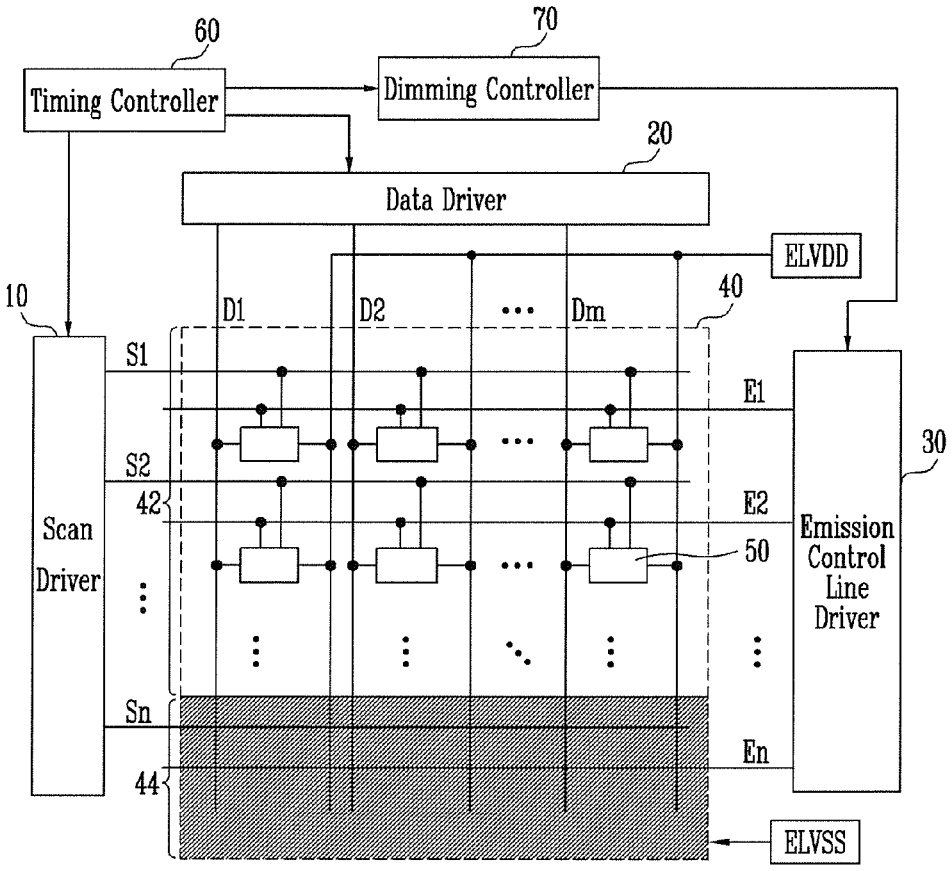
FIG. 4 is a view illustrating an organic light emitting display according to an embodiment of the present invention.

FIG. 4 is a view illustrating an organic light emitting display according to an embodiment of the present invention.

Referring to FIG. 4, the organic light emitting display according to the present embodiment of the present invention includes a display unit 40 including pixels 50 positioned at crossing regions of scan lines S1 to Sn, data lines D1 to Dm, and emission control lines E1 to En, a scan driver 10 for driving the scan lines S1 to Sn, a data driver 20 for driving the data lines D1 to Dm, an emission control line driver 30 for driving the emission control lines E1 to En, and a timing controller 60 for controlling the drivers 10, 20, and 30. In addition, the organic light emitting display according to the present embodiment of the present invention further includes a dimming controller 70.

The display unit 40 (or the panel) is divided into an active region 42 and a blank region 44. The active region 42 is a region for displaying an image and includes a plurality of the pixels 50. The pixels 50 positioned in the active region 42 generate light components (e.g., predetermined light components) corresponding to the data signals to realize gray levels.

The blank region 44 does not display an image. In the blank region 44, a plurality of scan lines and data lines are formed during processes. The blank region 44 may be positioned to overlap a housing to not be exposed to an observer.

The scan driver 10 sequentially supplies the scan signals (e.g., voltages by which the transistors included in the pixels may be turned on) to the scan lines S1 to Sn. When the scan signals are supplied to the scan lines S1 to Sn, the pixels 50 are selected in units of horizontal lines (e.g., one horizontal line at a time).

The data driver 20 supplies the data signals to the data lines D1 to Dm in synchronization with the scan signals. The data signals supplied to the data lines D1 to Dm are supplied to the pixels 50 selected by the scan signals. On the other hand, in the period where the scan signals are supplied to the scan lines positioned in the blank region 44 (e.g., scan line Sn in FIG. 4), the data driver 20 supplies a blank data signal or no data signal.

The emission control line driver 30 supplies emission control signals (e.g., voltages by which the transistors included in the pixels may be turned off) to the emission control lines E1 to En so that a light-emitting area (that is, the area of the pixels that may emit light) is uniform in the active region 42 corresponding to the control of the dimming controller 70. Therefore, the emission control line driver 30 supplies the emission control signals to the emission control lines E1 to En in non-synchronization with the scan signals. The width of the emission control signal supplied to the emission control line positioned in a specific horizontal line overlaps the scan signal supplied to the scan line positioned in the same specific horizontal line.

The dimming controller 70 controls the brightness of the display unit 40 to correspond to the externally supplied dimming signal via the timing controller 60. Therefore, the dimming controller 70 controls the emission control line driver 30 to control the width of the emission control signals. At this time, the emission control line driver 30 controls the emission control signals so that the pixels are turned on (emission) and turned off (non-emission) no less than two times, and supplies the emission control signals so that the area of the pixels 50 in which light is emitted is uniform in the active region 42.

The timing controller 60 controls the scan driver 10, the data driver 20, and the dimming controller 70.

Figure 5:
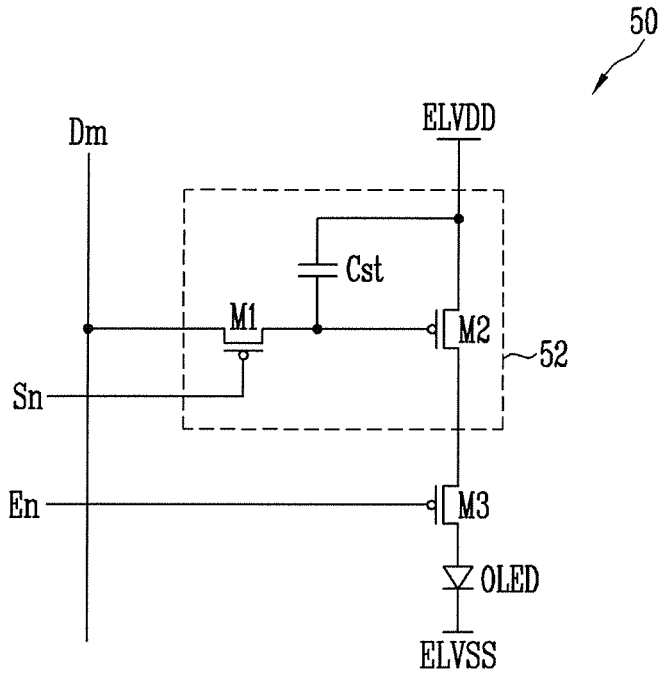
FIG. 5 is a view illustrating a embodiment of a pixel of the organic light emitting display of the embodiment shown in FIG. 4.

FIG. 5 is a view illustrating a pixel according to the present embodiment of the present invention.

Referring to FIG. 5, a pixel 50 according to the present embodiment of the present invention includes an organic light emitting diode (OLED), a pixel circuit 52 for controlling an amount of current supplied to the OLED, and a third transistor M3 coupled between the pixel circuit 52 and the OLED.

The anode electrode of the OLED is coupled to the third transistor M3, and the cathode electrode of the OLED is coupled to a second power source ELVSS. The OLED generates light of brightness (e.g., predetermined brightness) corresponding to the amount of current supplied from the pixel circuit 52.

The pixel circuit 52 controls the amount of current supplied to the OLED, and may be formed of various types of circuits known to those skilled in the art. For example, according to the present embodiment, the pixel circuit 52 includes a first transistor M1, a second transistor M2, and a storage capacitor Cst.

The first electrode of the first transistor M1 is coupled to the data line Dm, and the second electrode of the first transistor M1 is coupled to the gate electrode of the second transistor M2. The gate electrode of the first transistor M1 is coupled to the scan line Sn. The first transistor M1 is turned on when the scan signal is supplied to the scan line Sn to electrically couple the data line Dm to the gate electrode of the second transistor M2.

The first electrode of the second transistor M2 is coupled to the first power source ELVDD and the second electrode of the second transistor M2 is coupled to the first electrode of the third transistor M3. The gate electrode of the second transistor M2 is coupled to the second electrode of the first transistor M1. The second transistor M2 supplies the current corresponding to the voltage of the gate electrode thereof to the OLED.

The storage capacitor Cst is coupled between the gate electrode of the second transistor M2 and the first power source ELVDD. The storage capacitor Cst charges the voltage corresponding to the data signal.

The first electrode of the third transistor M3 is coupled to the pixel circuit 52, and the second electrode of the third transistor M3 is coupled to the anode electrode of the OLED. The gate electrode of the third transistor M3 is coupled to the emission control line En. The third transistor M3 is turned on when the emission control signal is supplied to the emission control line En, and the third transistor M3 is turned off when no emission control signal is received.

The pixel 50 according to the present embodiment of the present invention does not emit light in the period where the emission control signal is supplied so that the third transistor M3 is turned off, and emits light in the period where the emission control signal is not supplied (that is, a low voltage is supplied) so that the third transistor M3 is turned on.

Figure 6:
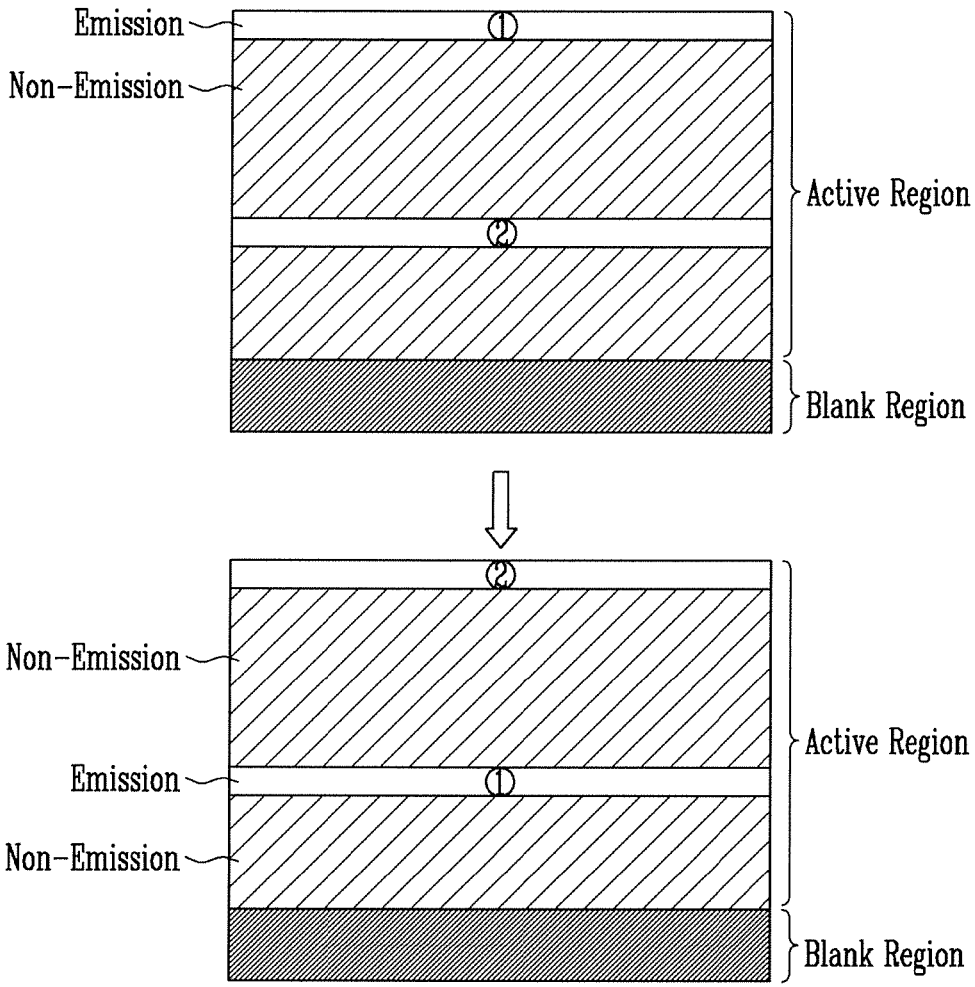
FIG. 6 is a view illustrating a light-emitting region according to an embodiment of the present invention.

FIG. 6 is a view illustrating a driving method according to the present embodiment of the present invention.

When operation processes are described in detail with reference to FIGS. 4 to 6, first, the dimming controller 70 supplies a dimming signal (e.g., a predetermined dimming signal) to the emission control line driver 30. The emission control line driver 30 supplies the emission control signals in a 2-duty method so that the pixels are turned on and off twice in one frame. The emission control line driver 30 supplies the emission control signals so that the light-emitting regions 1 and 2 in which the pixels emit light are positioned in the active region.

Figure 7:
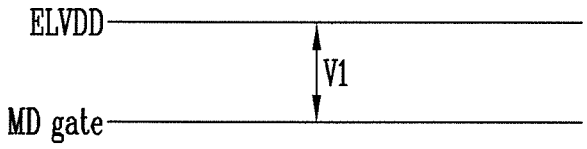
FIG. 7 is a view illustrating a change in the voltage of the first power source that corresponds to the light-emitting region of the embodiment shown in FIG. 6.

The emission control line driver 30 supplies the emission control signals in non-synchronization with the scan signals so that the light-emitting regions 1 and 2 are positioned (e.g., always positioned) in the active region 42 regardless of the scan signals supplied to the blank region 44. Then, during dimming, the area in which light may be emitted is uniformly set in the active region 42. Therefore, as illustrated in FIG. 7, the first power source ELVDD is maintained as the first voltage V1. That is, according to the present embodiment of the present invention, during dimming, the light-emitting region in which light is emitted is uniformly set in the active region 42 so that the voltage of the first power source ELVDD may be uniformly maintained, and so that it is possible to reduce or prevent noise in the form of horizontal stripes.

According to embodiments of the present invention, for the sake of convenience, it is illustrated that the voltage of the first power source ELVDD is maintained as the first power source V1. However, the voltage of the first power source ELVDD may partially change corresponding to the data signals and whether the pixels emit light. Since the amount of change in the voltage of the first power source ELVDD is smaller than in the case where the light-emitting region is positioned in the blank region, the voltage of the first power source ELVDD is illustrated as the first voltage V1.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display comprising:

first scan lines, data lines, and first emission control lines overlapping at an active region of the organic light emitting display for displaying an image;

second scan lines and second emission control lines overlapping at a blank region of the organic light emitting display outside the active region where no image is ever displayed;

pixels coupled to the first scan lines, the data lines, and the first emission control lines in the active region;

a dimming controller for controlling brightness of the pixels; and an emission control line driver for supplying emission control signals to the first and second emission control lines corresponding to control of the dimming controller so that a light-emitting area comprising ones of the pixels is uniform in the active region.

2. The organic light emitting display as claimed in claim 1, wherein the emission control line driver supplies the emission control signals so that ones of the pixels receiving the emission control signals are turned on and off at least two times in one frame.

3. The organic light emitting display as claimed in claim 1, further comprising:

a scan driver for supplying scan signals to the first scan lines and the second scan lines; and a data driver for supplying data signals to the data lines.

4. The organic light emitting display as claimed in claim 3, wherein a scan signal of the scan signals supplied to a scan line of the first and second scan lines at a horizontal line overlaps an emission control signal of the emission control signals supplied to an emission control line of the first and second emission control lines at the horizontal line.

5. The organic light emitting display as claimed in claim 2, wherein, when the pixels are turned on and off twice, the emission control line driver supplies the emission control signals so that a first light-emitting region and a second light-emitting region are in the active region.

6. A method of driving an organic light emitting display, the organic light emitting display comprising:

a panel comprising:

first scan lines and first emission control lines overlapping at an active region of the panel for displaying an image; and second scan lines and second emission control lines overlapping at a blank region of the panel outside the active region where no image is ever displayed, the method comprising:

sequentially supplying scan signals to first scan lines to select pixels in the active region; and supplying emission control signals for controlling emission times of the pixels, wherein a width of the emission control signals is controlled so that the pixels are turned on and off at least two times in one frame period, and so that a light-emitting area comprising ones of the pixels is uniform in the active region.

7. The method as claimed in claim 6, further comprising sequentially supplying the scan signals to second scan lines in the blank region.

8. The method as claimed in claim 6, wherein a scan signal of the scan signals supplied to a scan line of the first and second scan lines at a horizontal line overlaps an emission control signal of the emission control signals supplied to an emission control line of the emission control lines at the horizontal line.

9. The method as claimed in claim 6, wherein, when the pixels are turned on and off twice, a width of the emission control signals is controlled so that a first light-emitting region and a second light-emitting region are in the active region.

* * * * *